US008601832B2

(12) United States Patent
Tsukamoto

(10) Patent No.: US 8,601,832 B2
(45) Date of Patent: Dec. 10, 2013

(54) TURBO COMPRESSOR AND REFRIGERATOR

(75) Inventor: Minoru Tsukamoto, Yokohama (JP)

(73) Assignee: IHI Corporation (JP)

( * ) Notice: Subject to any disclaimer, the term of this patent is extended or adjusted under 35 U.S.C. 154(b) by 956 days.

(21) Appl. No.: 12/366,885

(22) Filed: Feb. 6, 2009

(65) Prior Publication Data

US 2009/0193843 A1 Aug. 6, 2009

(30) Foreign Application Priority Data

Feb. 6, 2008 (JP) ..... P2008-027067

(51) Int. Cl.

| | |
|---|---|
| ***F25B 1/10*** | (2006.01) |
| ***F25B 1/00*** | (2006.01) |
| ***F01D 3/02*** | (2006.01) |
| ***F04D 31/00*** | (2006.01) |

(52) U.S. Cl.
USPC ..... 62/510; 62/498; 415/100; 415/116

(58) Field of Classification Search
USPC ..... 62/498, 510; 418/7; 415/99, 100, 115, 415/116; 417/305, 351, 371
See application file for complete search history.

(56) References Cited

U.S. PATENT DOCUMENTS

| | | | | |
|---|---|---|---|---|
| 4,695,224 | A * | 9/1987 | Lown | 415/116 |
| 6,062,028 | A * | 5/2000 | Arnold et al. | 60/612 |
| 6,155,802 | A * | 12/2000 | Choi et al. | 417/366 |
| 6,619,072 | B2 * | 9/2003 | Seki et al. | 62/498 |
| 7,690,887 | B2 | 4/2010 | Takahashi et al. | |
| 2007/0147984 | A1 | 6/2007 | Takahashi et al. | 415/100 |
| 2007/0147985 | A1 | 6/2007 | Takahashi et al. | |

FOREIGN PATENT DOCUMENTS

| | | | |
|---|---|---|---|
| CN | 1081757 C | | 3/2002 |
| CN | 1991182 A | | 7/2007 |
| GB | 2062102 A | * | 5/1981 |
| JP | 08-284892 | | 10/1996 |
| JP | 2007-177695 | | 7/2007 |

OTHER PUBLICATIONS

Chinese Office Action dated Jul. 9, 2010 in counterpart Chinese Patent Application No. 200910003835.1 (with English language translation).

Japanese Office Action, dated Jun. 19, 2012, issued in corresponding Japanese Patent Application No. 2008-027067. English translation included. Total 4 pages.

* cited by examiner

*Primary Examiner* — Chen Wen Jiang
(74) *Attorney, Agent, or Firm* — Ostrolenk Faber LLP

(57) ABSTRACT

A turbo compressor has a plurality of stages of compression means, each including an impeller and a diffuser, arranged in tandem with the flow of a fluid, and is capable of compressing the fluid sequentially in a plurality of the compression means and supplying the fluid compressed in the compression means in a final stage to a condenser. The diffuser of at least the compression means in the final stage is a vaneless diffuser which does not include diffuser vanes which reduce the turning speed of the fluid in the diffuser. As such, according to this turbo compressor, it is possible to reduce generation of noise resulting from the transmission of turbulence of the fluid to the condenser, which occurs as the refrigerant collides against the diffuser vane.

6 Claims, 5 Drawing Sheets

TURBO COMPRESSOR AND REFRIGERATOR

BACKGROUND OF THE INVENTION

1. Field of the Invention

The present invention relates to a turbo compressor capable of compressing a fluid by a plurality of impellers, and a refrigerator including the turbo compressor.

Priority is claimed on Japanese Patent Application No. 2008-27067, filed Feb. 6, 2008, the content of which is incorporated herein by reference.

2. Description of the Related Art

As refrigerators which cool or freeze objects to be cooled, such as water, a turbo refrigerator or the like including a turbo compressor which compresses and discharges a refrigerant by impellers is known. In a compressor, when a compression ratio increases, the discharge temperature of the compressor becomes high and the volumetric efficiency thereof degrades. Thus, in the turbo compressor included in the above-mentioned turbo refrigerator or the like, a refrigerant may be compressed in a plurality of stages. For example, a turbo compressor which includes two compression stages provided with an impeller and a diffuser and which compresses a refrigerant sequentially in these compression stages is disclosed in Japanese Patent Unexamined Publication No. 2007-177695.

However, when a diffuser with vanes is used, diffuser vanes are arranged in the flow of a refrigerant. Therefore, the refrigerant will collide against the diffuser vanes. Hence, nonuniformity of the flow occurs in a peripheral direction at outlets of the diffuser vanes, and even a small amount of turbulence of the fluid is generated.

The turbo compressor installed in the turbo refrigerator is connected to the condenser which cools and liquefies the compressed refrigerant. For this reason, the turbulence of the fluid which occurs when the refrigerant collides against the diffuser vanes is transmitted to the condenser.

Also, in order to liquefy a refrigerant which has flowed in as gas in the condenser, a wide space into which the refrigerant as gas is filled exists inside the condenser. Accordingly, turbulence of the fluid transmitted to the condenser echoes, and noise are generated.

As such, the turbo refrigerator has a problem in that noise resulting from the transmission of turbulence of the fluid to the condenser, which occurs as the refrigerant collides against the diffuser vane, is generated.

SUMMARY OF THE INVENTION

The invention was made in view of the abovementioned problems, and aims at reducing noise in a turbo compressor connected to a condenser. In order to achieve the above object, the following means are adopted in the turbo compressor of the invention. That is, in a turbo compressor having a plurality of stages of compression means, each including an impeller and a diffuser, arranged in tandem with the flow of a fluid, and capable of compressing the fluid sequentially in the plurality of the compression means and supplying the fluid compressed in the compression means in a final stage to a condenser, the diffuser of at least the compression means in the final stage is a vaneless diffuser which does not includes diffuser vanes which reduce the turning speed of the fluid in the diffuser.

According to the turbo compressor of the invention having such features, a vaneless diffuser is used as the diffuser of the compression means in the final stage. For this reason, generation of turbulence of a fluid which occurs as the fluid collides against the diffuser vanes in the compression means in the final stage is prevented.

Additionally, in the turbo compressor of the invention, a configuration is adopted in which the compression means in a preceding stage of the compression means in the final stage includes a bypass flow path capable of supplying the fluid to the condenser, and the diffuser of the compression means to which the bypass flow path is connected is the vaneless diffuser.

Additionally, in the turbo compressor of the invention, a configuration is adopted in which, among the compression means, the diffuser of the compression means which does not directly supply the fluid to the condenser is a diffuser with vanes including diffuser vanes which reduce the turning speed of the fluid in the diffuser.

Next, the refrigerator of the invention relates to a refrigerator including a condenser which cools and liquefies a compressed refrigerant, an evaporator which evaporates the liquefied refrigerant and deprives vaporization heat from an object to be cooled, thereby cooling the object to be cooled, and a compressor which compresses the refrigerant evaporated in the evaporator and supplies the refrigerant to the condenser. This refrigerator includes the turbo compressor of the invention as a compressor.

According to the refrigerator of the invention having such features, similarly to the turbo compressor of the invention, generation of turbulence of a fluid which occurs as the fluid collides against the diffuser vanes in the compression means in the final stage included in the turbo compression is prevented.

According to the invention, generation of turbulence of a fluid which occurs as the fluid collides against the diffuser vanes in the compression means in the final stage included in the turbo compressor is prevented. For this reason, turbulence of a fluid can be prevented from being transmitted to the condenser from the compression means in the final stage, and generation of noise by echoing in the condenser can be prevented.

Accordingly, according to the invention, it is possible to reduce noise in the turbo compressor connected to the condenser.

DETAILED DESCRIPTION OF THE INVENTION

Hereinafter, one embodiment of a turbo compressor and a refrigerator according to the invention will be described with reference to the drawings. In addition, scales of individual members in the following drawings are appropriately changed so that each member can have a recognizable size.

First Embodiment

Figure 1:
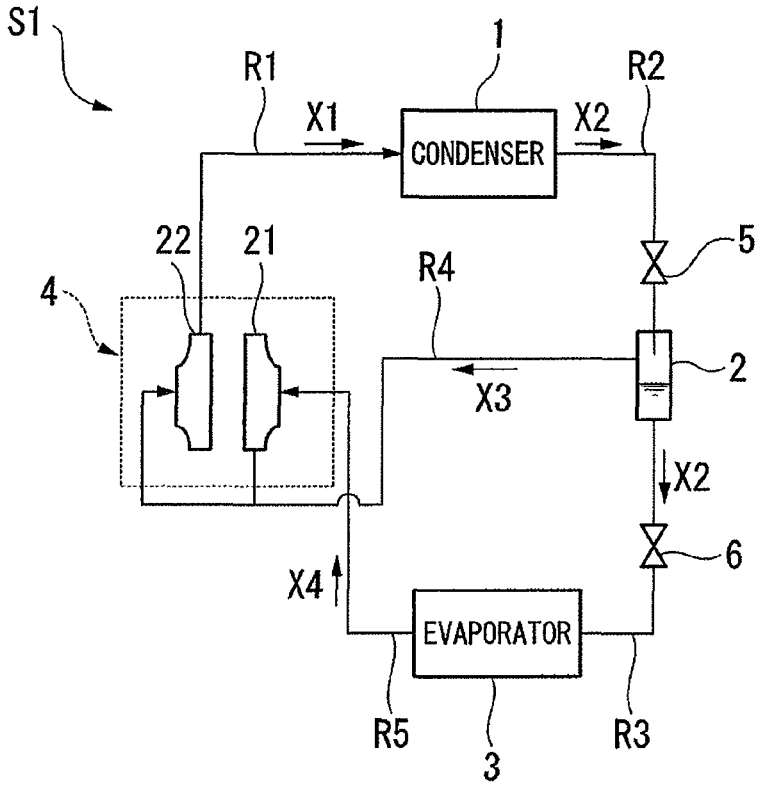
FIG. 1 is a block diagram showing a schematic configuration of a turbo refrigerator in a first embodiment of the invention.

FIG. 1 is a block diagram showing a schematic configuration of a turbo refrigerator S1 (refrigerator) in this embodiment.

The turbo refrigerator S1 in this embodiment is installed in buildings or factories in order to generate, for example, cooling water for air conditioning, and as shown in FIG. 1, includes a condenser 1, an economizer 2, an evaporator 3, and a turbo compressor 4.

The condenser 1 is supplied with a compressed refrigerant gas X1 that is a refrigerant (fluid) compressed in a gaseous state, and cools and liquefies the compressed refrigerant gas X1 to generate a refrigerant fluid X2. The condenser 1, as shown in FIG. 1, is connected to the turbo compressor 4 via a flow path R1 through which the compressed refrigerant gas X1 flows, and is connected to the economizer 2 via a flow path R2 through which the refrigerant fluid X2 flows. In addition, an expansion valve 5 for decompressing the refrigerant fluid X2 is installed in the flow path R2.

The economizer 2 temporarily stores the refrigerant fluid X2 decompressed in the expansion valve 5. The economizer 2 is connected to the evaporator 3 via a flow path R3 through which the refrigerant fluid X2 flows, and is connected to the turbo compressor 4 via a flow path R4 through which a gaseous refrigerant X3 generated in the economizer 2 flows. In addition, an expansion valve 6 for further decompressing the refrigerant fluid X2 is installed in the flow path R3. Additionally, the flow path R4 is connected to the turbo compressor 4 so as to supply the gaseous refrigerant X3 to a second compression stage 22 (which will be described later) included in the turbo compressor 4.

The evaporator 3 evaporates the refrigerant fluid X2 to deprive vaporization heat from an object to be cooled, such as water, thereby cooling an object to be cooled. The evaporator 3 is connected to the turbo compressor 4 via a flow path R5 through which a refrigerant gas X4 generated as the refrigerant fluid X2 is evaporated and flows. In addition, the flow path R5 is connected to a first compression stage 21 (which will be described later) included in the turbo compressor 4.

The turbo compressor 4 compresses the refrigerant gas X4 to generate the compressed refrigerant gas X1.

The turbo compressor 4 is connected to the condenser 1 via the flow path R1 through which the compressed refrigerant gas X1 flows as described above, and is connected to the evaporator 3 via the flow path R5 through which the refrigerant gas X4 flows.

In the turbo refrigerator S1 configured in this way, the compressed refrigerant gas X1 supplied to the condenser 1 via the flow path R1 is cooled and liquefied into the refrigerant fluid X2 by the condenser 1.

When the refrigerant fluid X2 is supplied to the economizer 2 via the flow path R2, the refrigerant fluid is decompressed by the expansion valve 5. In this decompressed state, the refrigerant fluid is temporarily stored in the economizer 2. Then, when the refrigerant fluid is supplied to the evaporator 3 via the flow path R3, the refrigerant fluid is further decompressed by the expansion valve 6, and is supplied to the evaporator 3 in the decompressed state.

The refrigerant fluid X2 supplied to the evaporator 3 is evaporated into the refrigerant gas X4 by the evaporator 3, and supplied to the turbo compressor 4 via the flow path R5.

The refrigerant gas X4 supplied to the turbo compressor 4 is compressed into the compressed refrigerant gas X1 by the turbo compressor 4, and is supplied again to the condenser 1 via the flow path R1.

In addition, the gaseous refrigerant X3 generated when the refrigerant fluid X2 is stored in the economizer 2 is supplied to the turbo compressor 4 via the flow path R4, compressed along with the refrigerant gas X4, and supplied to the condenser 1 via the flow path R1 as the compressed refrigerant gas X1.

In such a turbo refrigerator S1, when the refrigerant fluid X2 is evaporated in the evaporator 3, vaporization heat is removed from an object to be cooled, thereby cooling or refrigerating the object to be cooled.

Figure 2:
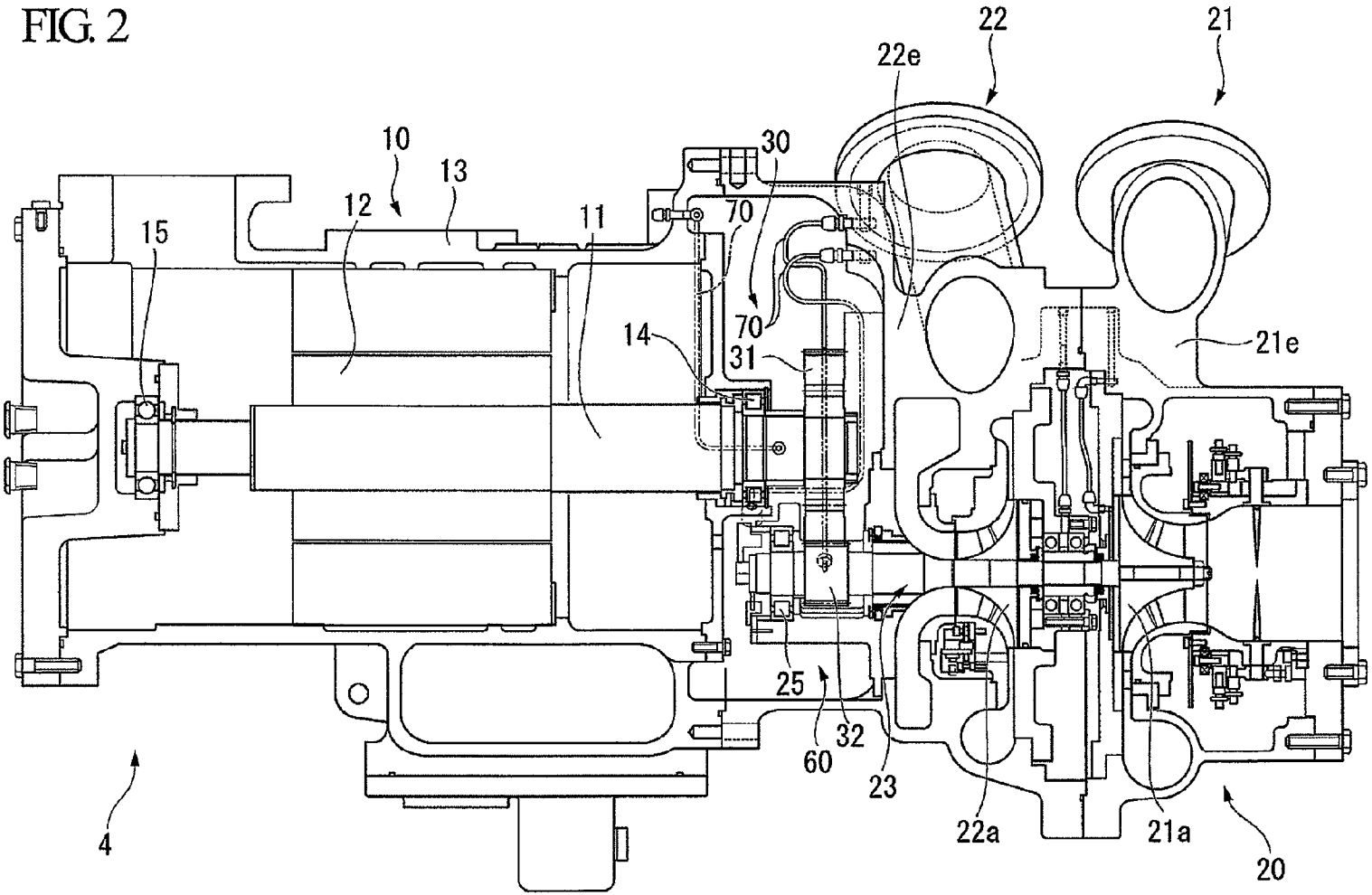
FIG. 2 is a horizontal sectional view of a turbo compressor included in the turbo refrigerator in the first embodiment of the invention.
Figure 3:
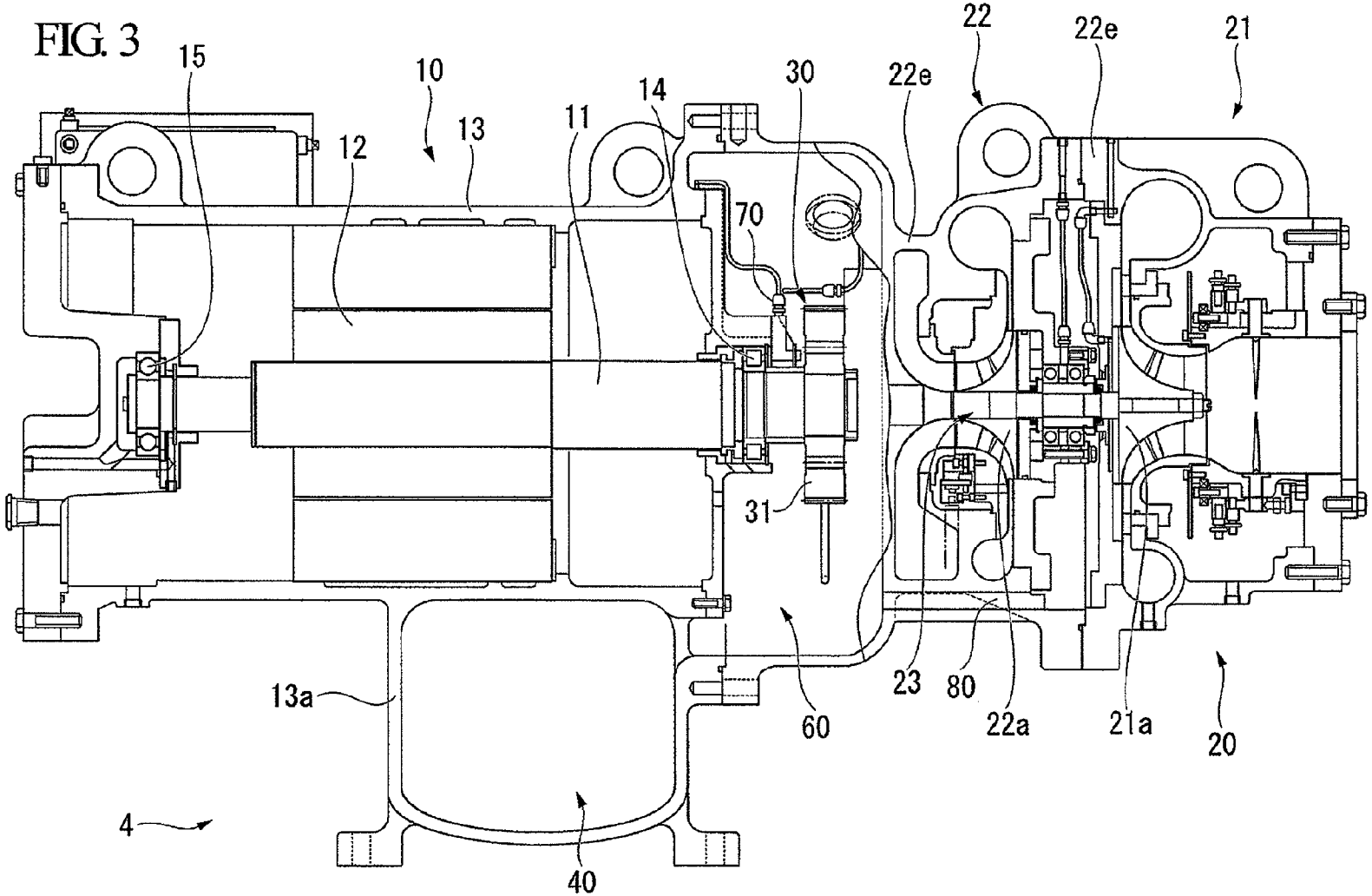
FIG. 3 is a vertical sectional view of the turbo compressor included in the turbo refrigerator in the first embodiment of the invention.
Figure 4:
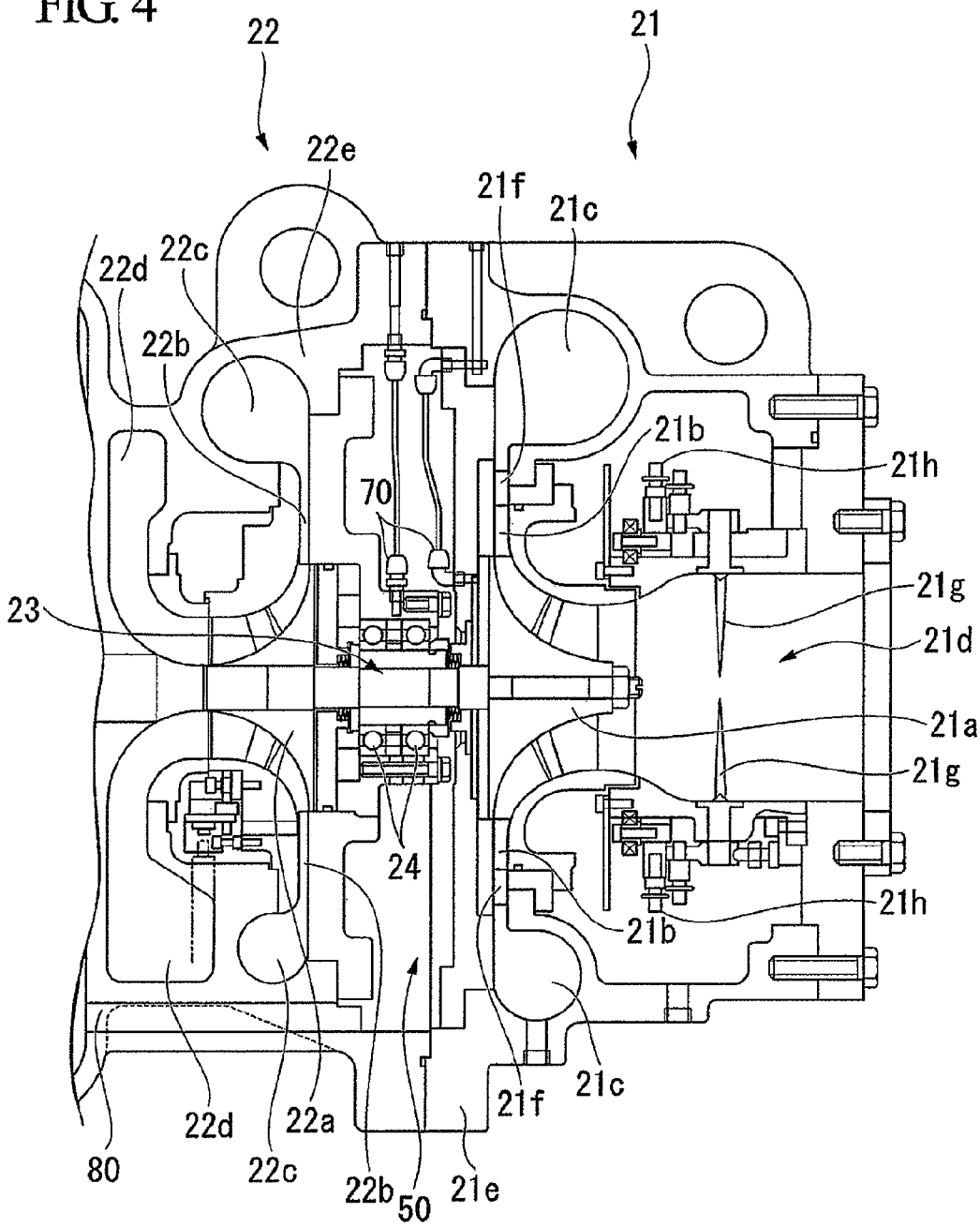
FIG. 4 is an enlarged view of essential parts of FIG. 3.

Subsequently, the turbo compressor 4 that is a characterizing portion of this embodiment will be described in more detail. FIG. 2 is a horizontal sectional view of the turbo compressor 4. Additionally, FIG. 3 is a vertical sectional view of the turbo compressor 4. Additionally, FIG. 4 is an enlarged vertical sectional view of a compressor unit 20 included in the turbo compressor 4.

As shown in these drawings, the turbo compressor 4 in this embodiment includes a motor unit 10, a compressor unit 20, and a gear unit 30.

The motor unit 10 includes a motor 12 which has an output shaft 11 and serves as a driving source for driving the compressor unit 20, and a motor housing 13 which surrounds the motor 12 and supports the motor 12.

In addition, the output shaft 11 of the motor 12 is rotatably supported by a first bearing 14 and a second bearing 15 which are fixed to the motor housing 13.

Additionally, the motor housing 13 includes a leg portion 13*a* which supports the turbo compressor 4.

Also, the inside of the leg portion 13*a* is made hollow, and used as an oil tank 40 where lubricant supplied to sliding parts of the turbo compressor 4 is recovered and stored.

The compression unit 20 includes the first compression stage 21 (compression means) where the refrigerant gas X4 (refer to FIG. 1) is sucked and compressed, and the second compression stage 22 (compression means) where the refrigerant gas X4 compressed in the first compression stage 21 is further compressed and discharged as compressed refrigerant gas X1 (refer to FIG. 1).

The first compression stage 21, as shown in FIG. 4, includes a first impeller 21*a* (impeller), a first diffuser 21*b* (diffuser), a first scroll chamber 21*c*, and a suction port 21*d*. The first impeller 21*a* gives velocity energy to the refrigerant gas X4 to be supplied from a thrust direction, and discharges the refrigerant gas in a radial direction. The first diffuser 21*b* converts the velocity energy, which is given to the refrigerant gas X4 by the first impeller 21*a*, into pressure energy, thereby compressing the refrigerant gas. The first scroll chamber 21*c* guides the refrigerant gas X4 compressed by the first diffuser 21*b* to the outside of the first compression stage 21. The suction port 21*d* allows the refrigerant gas X4 to be sucked therethrough and supplied to the first impeller 21*a*.

In addition, the first diffuser 21*b*, the first scroll chamber 21*c*, and a portion of the suction port 21*d* are formed by a first housing 21*e* surrounding the first impeller 21*a*.

The first impeller 21*a* is fixed to a rotation shaft 23, and is rotationally driven as the rotation shaft 23 has rotative power transmitted thereto from the output shaft 11 of the motor 12 and is rotated.

The first diffuser 21*b* is annularly arranged around the first impeller 21*a*. In the turbo compressor 4 of this embodiment, the first diffuser 21*b* is a diffuser with vanes including a plurality of diffuser vanes 21*f* which reduces the turning speed of the refrigerant gas X4 in the first diffuser 21*b*, and efficiently converts velocity energy into pressure energy.

Additionally, a plurality of inlet guide vanes 21*g* for adjusting the suction capacity of the first compression stage 21 is installed in the suction port 21*d* of the first compression stage 21.

Each inlet guide vane 21*g* is rotatable by a driving mechanism 21*h* fixed to the first housing 21*e* so that its apparent area from a flow direction of the refrigerant gas X4 can be changed.

Figure 5:
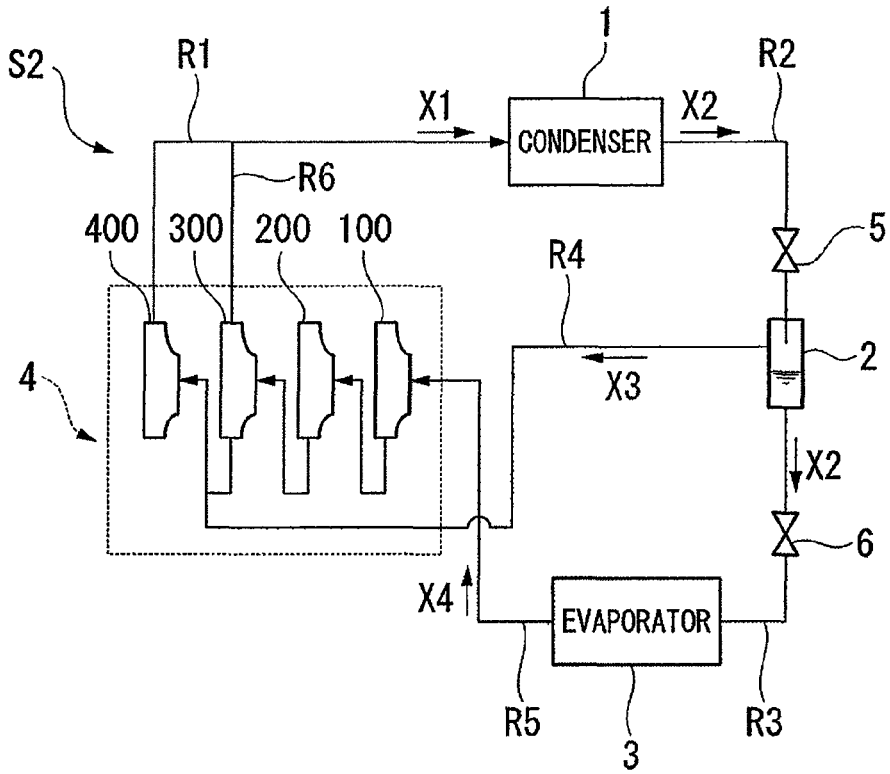
FIG. 5 is a block diagram showing a schematic configuration of a turbo refrigerator in a second embodiment of the invention.

The second compression stage 22, as shown in FIG. 5, includes a second impeller 22*a* (impeller), a second diffuser 22*b* (diffuser), a second scroll chamber 22*c*, and an introducing scroll chamber 22*d*. The second impeller 22*a* gives velocity energy to the refrigerant gas X4 which is compressed in the first compression stage 21 and supplied from the thrust direction, and discharges the refrigerant gas in the radial direction. The second diffuser 22*b* converts the velocity energy, which is given to the refrigerant gas X4 by the second impeller 22*a*, into pressure energy, thereby compressing the refrigerant gas and discharging it as the compressed refrigerant gas X1. The second scroll chamber 22*c* guides the compressed refrigerant gas X1 discharged from the second diffuser 22*b* to the outside of the second compression stage 22. The introducing scroll chamber 22*d* guides the refrigerant gas X4 compressed in the first compression stage 21 to the second impeller 22*a*

In addition, the second diffuser 22*b*, the second scroll chamber 22*c*, and a portion of the introducing scroll chamber 22*d* are formed by a second housing 22*e* surrounding the second impeller 22*a*.

The second impeller 22*a* is fixed to the rotation shaft 23 so as to face the first impeller 21*a* back to back and rotationally driven as the rotation shaft 23 has rotative power transmitted thereto from the output shaft 11 of the motor 12 and is rotated.

The second diffuser 22*b* is annularly arranged around the second impeller 22*a*. In the turbo compressor 4 of this embodiment, the second diffuser 21*b* is a vaneless diffuser which does not include a diffuser vane which reduces the turning speed of the refrigerant gas X4 in the second diffuser 22*b*, and efficiently converts velocity energy into pressure energy.

The second scroll chamber 22*c* is connected to the flow path R1 for supplying the compressed refrigerant gas X1 to the condenser 1, and supplies the compressed refrigerant gas X1 drawn from the second compression stage 22 to the flow path R1.

In addition, the first scroll chamber 21*c* of the first compression stage 21 and the introducing scroll chamber 22*d* of the second compression stage 22 are connected together via an external pipe (not shown) which is provided separately from the first compression stage 21 and the second compression stage 22, and the refrigerant gas X4 compressed in the first compression stage 21 is supplied to the second compression stage 22 via the external pipe. The aforementioned flow path R4 (refer to FIG. 1) is connected to this external pipe, and the gaseous refrigerant X3 generated in the economizer 2 is supplied to the second compression stage 22 via the external pipe.

Additionally, the rotation shaft 23 is rotatably supported by a third bearing 24 fixed to the second housing 22*e* of the second compression stage 22, and a fourth bearing 25 fixed to the second housing 22*e* on the side of the motor unit 10, in a space 50 between the first compression stage 21 and the second compression stage 22.

The gear unit 30 is for transmitting the rotative power of the output shaft 11 of the motor 12 to the rotation shaft 23, and is housed in a space 60 formed by the motor housing 13 of the motor unit 10, and the second housing 22*e* of the compressor unit 20.

The gear unit 30 is comprised of a large-diameter gear 31 fixed to the output shaft 11 of the motor 12, and a small-diameter gear 32 which is fixed to the rotation shaft 23, and meshes with the large-diameter gear 31. The gear unit 30 transmits the rotative power of the output shaft 11 of the motor 12 to the rotation shaft 23 so that the rotation number of the rotation shaft 23 may increase with an increase in the rotation number of the output shaft 11.

Additionally, the turbo compressor 4 includes a lubricant-supplying device 70 which supplies lubricant stored in the oil tank 40 to bearings (the first bearing 14, the second bearing 15, the third bearing 24, and the fourth bearing 25), to between an impeller (the first impeller 21*a*, or the second impeller 22*a*) and a housing (the first housing 21*e* or the second housing 22*e*), and to sliding parts, such as the gear unit 30. In addition, only a portion of the lubricant-supplying device 70 is shown in the drawing.

In addition, the space 50 where the third bearing 24 is arranged and the space 60 where the gear unit 30 is housed are connected together by a through-hole 80 formed in the second housing 22*e*, and the space 60 and the oil tank 40 are connected together. For this reason, the lubricant which is supplied to spaces 50 and 60, and flows down from the sliding parts is recovered to the oil tank 40.

Next, the operation of the turbo compressor 4 in this embodiment configured in this way will be described.

First, lubricant is supplied to respective sliding parts of the turbo compressor 4 from the oil tank 40 by the lubricant-supplying device 70, and then, the motor 12 is driven. Then, the rotative power of the output shaft 11 of the motor 12 is transmitted to the rotation shaft 23 via the gear unit 30, and thereby, the first impeller 21*a* and the second impeller 22*a* of the compressor unit 20 are rotationally driven.

When the first impeller 21*a* is rotationally driven, the suction port 21*d* of the first compression stage 21 is in a negative pressure state, and the refrigerant gas X4 from the flow path R5 flows into the first compression stage 21 via the suction port 21*d*.

The refrigerant gas X4 which has flowed into the inside of the first compression stage 21 flows into the first impeller 21*a* from the thrust direction, and the refrigerant gas has velocity energy given thereto by the first impeller 21*a*, and is discharged in the radial direction.

The refrigerant gas X4 discharged from the first impeller 21*a* is compressed as velocity energy and is converted into pressure energy by the first diffuser 21*b*. Here, the first diffuser 21*b* in the turbo compressor 4 in the embodiment is a diffuser with vanes. Therefore, as the refrigerant gas X4 collides against the diffuser vane 21*f*, the turning speed of the refrigerant gas X4 is reduced rapidly, and the velocity energy thereof is converted into pressure energy with high efficiency.

The refrigerant gas X4 discharged from the first diffuser 21*b* is guided to the outside of the first compression stage 21 via the first scroll chamber 21*c*.

Then, the refrigerant gas X4 guided to the outside of the first compression stage 21 is supplied to the second compression stage 22 via the external pipe.

The refrigerant gas X4 supplied to the second compression stage 22 flows into the second impeller 22*a* from the thrust direction via the introducing scroll chamber 22*d*, and the refrigerant gas has velocity energy given thereto by the second impeller 22*a*, and is discharged in the radial direction.

The refrigerant gas X4 discharged from the second impeller 22*a* is further compressed into the compressed refrigerant gas X1 as velocity energy is converted into pressure energy by the second diffuser 22*b*. Here, in the turbo compressor 4 in this embodiment, the second diffuser 22*b* is a vaneless diffuser. Therefore, there is no generation of turbulence of a fluid which occurs as the refrigerant gas X4 collides against the diffuser vane.

The compressed refrigerant gas X1 discharged from the second diffuser 22*b* is guided to the outside of the second compression stage 22 via the second scroll chamber 22*c*.

Then, the compressed refrigerant gas X1 guided to the outside of the second compression stage 22 is supplied to the condenser 1 via the flow path R1. Here, in the turbo compressor 4 in this embodiment, no turbulence of a fluid which occurs as the refrigerant gas X4 collides against the diffuser vane is generated in the second diffuser 22*b*. Therefore, the turbulence of the fluid is not transmitted to the condenser 1. Consequently, turbulence of a fluid can be prevented from echoing inside the condenser 1, and causing noise.

In the turbo compressor 4 in this embodiment as described above, the first compression stage 21, and the second compression stage 22 are arranged in tandem with the flow of a refrigerant.

Additionally, a refrigerant can be compressed sequentially by the first compression stage 21 and second compression stage 22, and the compressed refrigerant gas X1 which is a refrigerant compressed in the second compression stage 22 that is a final compression stage can be supplied to the condenser 1.

Also, according to the turbo compressor 4 in this embodiment, generation of turbulence of a fluid which occurs as the diffuser vane and a refrigerant collide against each other in the second compression stage 22 which is a final compression stage included in the turbo compressor 4 is prevented. For this reason, turbulence of a fluid can be prevented from being transmitted to the condenser 1 from the second compression stage 22, and generation of noise by echoing in the condenser 1 can be prevented.

Accordingly, according to the turbo compressor 4 in this embodiment, it is possible to reduce noise.

Additionally, the configuration in which the diffuser (first diffuser 21*b*) of the first compression stage 21 in the two compression stages 21 and 22, which is a compression stage which does not directly supply a refrigerant to the condenser 1, is a diffuser with vanes is adopted in the turbo compressor 4 in this embodiment.

According to the turbo compressor 4 in this embodiment which adopts such a configuration, velocity energy can be efficiently converted into pressure energy in the first diffuser 21*b*. It is thus possible to reduce the noise, and achieve the high efficiency of the turbo compressor.

Also, the turbo refrigerator S1 in this embodiment includes the turbo compressor 4 with reduced noise as described above.

For this reason, according to the turbo refrigerator S1 in this embodiment, it is possible to reduce noise.

Second Embodiment

Next, a second embodiment of the invention will be described. In addition, in the second embodiment, description of the same portions as those in the first embodiment is omitted or simplified.

FIG. 5 is a block diagram showing a schematic configuration of a turbo refrigerator S2 (refrigerator) in this embodiment.

As shown in this drawing, the turbo compressor 4 of the turbo refrigerator S2 in this embodiment includes a total of four compression stages of a first compression stage 100, a second compression stage 200, a third compression stage 300, and a fourth compression stage 400.

In addition, the flow path R1 through which the compressed refrigerant gas X1 flows is connected to the fourth compression stage 400 as a final stage.

Additionally, an openable/closable bypass flow path R6 which allows a refrigerant to be supplied directly to the condenser 1 from the third compression stage 300 that is a compression stage as a preceding stage of the fourth compression stage 400 that is a final compression stage is installed in the turbo compressor 4 in this embodiment.

Also, vaneless diffusers are used as a diffuser included in the third compression stage 300 and a diffuser included in the fourth compression stage 400, and diffusers with vanes are used as a diffuser included in the first compression stage 100 and a diffuser included in the second compression stage 200.

In such a turbo compressor 4 in this embodiment, the compressed refrigerant gas X1 discharged from the fourth compression stage 400 is supplied to the condenser 1 via the flow path R1, and if necessary, the compressed refrigerant gas (refrigerant gas compressed by the first compression stage 100, the second compression stage 200, and the third compression stage 300) is supplied to the condenser 1 via the bypass flow path R6 from the third compression stage 300.

Also, in the turbo compressor 4 in this embodiment, vaneless diffusers are used as the diffusers of the third compression stage 300 and the fourth compression stage 400 which can directly supply a refrigerant to the condenser 1. Therefore, generation of turbulence of a fluid which occurs as a refrigerant collides against a diffuser vane can be prevented from being transmitted to the condenser 1.

Accordingly, according to the turbo refrigerator S1 and turbo compressor 4 in this embodiment, it is possible to reduce noise.

Additionally, the configuration in which the diffuser of the first compression stage 100 and the diffuser of the second compression stage 200, which are compression stages which do not directly supply a refrigerant to the condenser 1, are diffusers with vanes is adopted in the turbo compressor 4 in this embodiment.

According to the turbo compressor 4 in this embodiment which adopts such a configuration, velocity energy can be efficiently converted into pressure energy in the first compression stage 100 and the second compression stage 200. It is thus possible to reduce the noise, and achieve the high efficiency of the turbo compressor.

Although the preferred embodiments of the turbo compressor and the refrigerator according to the invention have been described with reference to the accompanying drawings, it is needless to say that the invention is not limited to the above embodiments, and is only limited by the scope of the appended claims. Various shapes or combinations of respective constituent members illustrated in the above-described embodiments are merely examples, and various changes may be made depending on design requirements or the like without departing from the spirit or scope of the present invention.

For example, the configuration including two compression stages (the first compression stage 21 and the second compression stage 22) has been described in the above first embodiment, and the configuration including four compression stages (the first compression stage 100, the second compression stage 200, the third compression stage 300, and the fourth compression stage 400) has been described in the second embodiment.

However, the invention is not limited thereto, and a configuration including three compression stages or five or more compression stages may be adopted.

Additionally, the configuration in which diffusers included in compression stages which do no directly supply a refrigerant to the condenser 1 are diffusers with vanes has been described in the above embodiments.

However, the invention is not limited thereto, and diffusers included in compression stages which do not directly supply a refrigerant to the condenser may be vaneless diffusers.

Additionally, it has been described in the above embodiments that the turbo refrigerator is installed in buildings or factories in order to generate cooling water for air conditioning.

However, the invention is not to be limited thereto, and can be applied to freezers or refrigerators for home use or business use, or air conditioners for home use.

Additionally, it has been described in the above first embodiment that the first impeller 21*a* included in the first compression stage 21, and the second impeller 22*a* included in the second compression stage 22 are made to face each other back to back.

However, the invention is not limited thereto, and may be configured so that the back of the first impeller 21*a* included in the first compression stage 21 and the back of the second impeller 22*a* included in the second compression stage 22 face the same direction.

Additionally, the turbo compressor in which the motor unit 10, the compression unit 20, and the gear unit 30 are provided respectively has been described in the first embodiment.

However, the invention is not limited thereto and for example, and a configuration in which a motor is arranged between the first compression stage and the second compression stage may be adopted.

What is claimed is:

1. A turbo compressor comprising:

a plurality of compression modules including a final stage compression module positioned and configured to supply fluid compressed to a condenser and a non-final stage compression module positioned and configured to supply the fluid compressed to the final stage compression module, each compression module including an impeller and a diffuser, arranged in tandem with a flow of the fluid, and configured to compress the fluid sequentially in the plurality of compression modules, wherein the diffuser of the non-final stage compression module is positioned and configured to supply no fluid directly to the condenser and comprises vanes including diffuser vanes positioned and configured to reduce a turning speed of the fluid in the diffuser, and the diffuser of the final stage compression module is a vaneless diffuser no diffuser vanes reducing the turning speed of the fluid in the diffuser.

2. The turbo compressor according to claim 1, further comprising a second non-final stage compression module positioned and configured to compress the fluid received from the non-final stage compression module and to supply the fluid compressed directly to the final compression module, wherein the second non-final stage compression module includes an impeller, a vaneless diffuser and a bypass flow path and is positioned and configured to supply the fluid directly to the condenser through the bypass flow path.

3. A refrigerator comprising:

a condenser configured to cool and to liquify a compressed refrigerant;

an evaporator positioned and configured to evaporate the liquefied refrigerant and to deprive vaporization heat from an object to be cooled, thereby cooling the object to be cooled; and a compressor configured to compress the refrigerant evaporated in the evaporator and to supply the refrigerant to the condenser, wherein the compressor comprises the turbo compressor according to claim 2.

4. A refrigerator comprising:

a condenser configured to cool and to liquify a compressed refrigerant;

an evaporator positioned and configured to evaporate the liquefied refrigerant and to deprive vaporization heat from an object to be cooled, thereby cooling the object to be cooled; and a compressor configured to compress the refrigerant evaporated in the evaporator and to supply the refrigerant to the condenser, wherein the compressor comprises the turbo compressor according to claim 1.

5. A turbo refrigeration system comprising a turbo compressor according to claim 1.

6. A turbo compressor comprising:

a plurality of compression modules including a final stage compression module positioned and configured to supply fluid compressed to a condenser and at least one non-final stage compression module positioned and configured to supply the fluid compressed to the final stage compression module and to supply no fluid directly to the condenser, each compression module including an impeller and a diffuser, arranged in tandem with a flow of the fluid, and configured to compress the fluid sequentially in the plurality of compression modules, wherein the diffuser of the final stage compression module is a vaneless diffuser including no diffuser vanes reducing the turning speed of the fluid in the diffuser;

each module of the at least one non-final stage compression module comprising vanes including diffuser vanes positioned and configured to reduce a turning speed of the fluid in the diffuser; and an additional compression module position and configured to receive the fluid from the at least one non-final stage compression module and to supply the fluid directly to the final stage compression module and including a bypass flow path positioned and configured to supply the fluid directly to the condenser through the bypass flow path, and the additional compression module comprising a vaneless diffuser.

* * * * *